US010213830B2

(12) United States Patent
Shinohara et al.

(10) Patent No.: US 10,213,830 B2
(45) Date of Patent: Feb. 26, 2019

(54) PRODUCTION METHOD OF SINTERED ALLOY, SINTERED-ALLOY COMPACT, AND SINTERED ALLOY

(71) Applicants: TOYOTA JIDOSHA KABUSHIKI KAISHA, Toyota-shi, Aichi-ken (JP); FINE SINTER CO., LTD, Kasugai-chi, Aichi (JP)

(72) Inventors: Nobuyuki Shinohara, Tajimi (JP); Kimihiko Ando, Toyota (JP); Yoshihisa Ueda, Nagaokakyo (JP); Yusaku Yoshida, Tajimi (JP); Masaru Sugimoto, Tajimi (JP)

(73) Assignees: TOYOTA JIDOSHA KABUSHIKI KAISHA, Toyota-shi, Aichi-ken (JP); FINE SINTER CO., LTD, Kasugai-shi, Aichi (JP)

( * ) Notice: Subject to any disclaimer, the term of this patent is extended or adjusted under 35 U.S.C. 154(b) by 0 days.

(21) Appl. No.: 15/412,597

(22) Filed: Jan. 23, 2017

(65) Prior Publication Data

US 2017/0209928 A1 Jul. 27, 2017

(30) Foreign Application Priority Data

Jan. 25, 2016 (JP) ..... 2016-011504

(51) Int. Cl.

| | |
|---|---|
| ***B22F 3/10*** | (2006.01) |
| ***B22F 1/00*** | (2006.01) |
| ***C22C 38/02*** | (2006.01) |
| ***C22C 38/04*** | (2006.01) |
| ***C22C 38/10*** | (2006.01) |
| ***C22C 38/12*** | (2006.01) |

(52) U.S. Cl.

CPC ..... *B22F 3/10* (2013.01); *B22F 1/0003* (2013.01); *B22F 1/0011* (2013.01); *C22C 38/02* (2013.01); *C22C 38/04* (2013.01); *C22C 38/10* (2013.01); *C22C 38/105* (2013.01); *C22C 38/12* (2013.01); *B22F 2301/35* (2013.01); *B22F 2304/10* (2013.01)

(58) Field of Classification Search

None

See application file for complete search history.

(56) References Cited

U.S. PATENT DOCUMENTS

2004/0103753 A1 6/2004 Ando

FOREIGN PATENT DOCUMENTS

JP 2004-156101 A 6/2004

*Primary Examiner* — David Sample
*Assistant Examiner* — Elizabeth Collister
(74) *Attorney, Agent, or Firm* — Sughrue Mion, PLLC

(57) ABSTRACT

A sintered alloy is produced from mixed powder containing first hard particles, second hard particles, graphite particles, and iron particles. The first hard particles are Fe—Mo—Ni—Co—Mn—Si—C-based alloy particles, the second hard particles are Fe—Mo—Si-based alloy particles, the mixed powder contains 5 to 50 mass % of the first hard particles, 1 to 8 mass % of the second hard particles, and 0.5 to 1.5 mass % of the graphite particles, when total mass of the first hard particles, the second hard particles, the graphite particles, and the iron particles is set as 100 mass %.

10 Claims, 9 Drawing Sheets

PRODUCTION METHOD OF SINTERED ALLOY, SINTERED-ALLOY COMPACT, AND SINTERED ALLOY

INCORPORATION BY REFERENCE

The disclosure of Japanese Patent Application No. 2016-011504 filed on Jan. 25, 2016 including the specification, drawings and abstract is incorporated herein by reference in its entirety.

BACKGROUND

1. Technical Field

The present disclosure relates to a production method of a sintered alloy, a sintered-alloy compact, and a sintered alloy.

2. Description of Related Art

A sintered alloy containing iron as the base may be applied to a valve seat or the like of an internal combustion engine. In order to further improve wear resistance, hard particles may be included in a sintered alloy. In a case where hard particles are included, graphite particles and iron particles are mixed with the hard particles into a powder, and the mixed powder is compacted into a sintered-alloy compact. Thereafter, by heating the sintered-alloy compact and sintering the resultant, a sintered alloy is generally obtained.

As a production method of such a sintered alloy, a production method of a wear-resistant iron-based sintered alloy, in which mixed powder obtained by mixing hard particles, graphite particles, and iron particles together is compacted into a sintered-alloy compact, and the sintered-alloy compact is sintered while causing carbon (C) of the graphite particles of the sintered-alloy compact to diffuse into the hard particles and the iron particles, is suggested (for example, refer to Japanese Patent Application Publication No. 2004-156101 (JP 2004-156101 A)).

Here, the hard particles contains 20 to 70 mass % of Mo, C: 0.2 to 3 mass %, Mn: 1 to 15 mass %, and the remainder including unavoidable impurities and Co, and the mixed powder contains, when the total amount of the hard particles, the graphite particles, and the iron particles is assumed to be 100 mass %, 10 to 60 mass % of the hard particles and 0.2 to 2 mass % of the graphite particles. Since the hard particles are dispersed in the sintered alloy, abrasive wear can be suppressed.

SUMMARY

However, a matrix material that connects the hard particles of the sintered alloy produced in the production method described in JP 2004-156101 A is an Fe—C-based material in which C of the graphite particles is diffused into the iron particles, and is thus soft. Therefore, when the wear-resistant iron-based sintered alloy and a metal material of a sliding mating material that comes into contact therewith undergo metal-to-metal contact with each other, the contact surface of the sintered alloy is likely to be plastically deformed, and adhesive wear easily occurs on the contact surface. In order to prevent this, it is desirable that the hardness of the sintered alloy is increased. On the other hand, there is concern that this may cause a reduction in the machinability of the sintered alloy. Therefore, it is difficult to achieve both adhesive wear resistance and machinability.

The present disclosure provides a production method of a sintered alloy, a sintered-alloy compact, and a sintered alloy capable of securing machinability while suppressing adhesive wear.

The inventors thought that adhesive wear on the contact surface is accelerated due to the plastic deformation of the iron-based base of the sintered alloy as described above. From this viewpoint, the inventors examined the addition of another kind of hard particles capable of suppressing the plastic deformation of the iron-based base, in addition to the hard particles for suppressing abrasive wear in the related art. Here, the inventors focused on molybdenum as the primary component of the hard particles, and obtained the knowledge that by causing intermetallic compounds containing iron and molybdenum and molybdenum carbide precipitated during sintering to be scattered in an iron-based base, plastic deformation of the iron-based base can be controlled.

The present disclosure is based on the above-described knowledge, and a first aspect of the present disclosure relates to a production method of a sintered alloy including compacting mixed powder containing first hard particles, second hard particles, graphite particles, and iron particles into a sintered-alloy compact; and sintering the sintered-alloy compact while diffusing carbons in the graphite particles of the sintered-alloy compact into the first hard particles, the second hard particles, and the iron particles, wherein the first hard particles contain 20 to 70 mass % of Mo, 5 to 40 mass % of Ni, 5 to 40 mass % of Co, 1 to 20 mass % of Mn, 0.5 to 4.0 mass % of Si, 0.5 to 3.0 mass % of C, and a remainder including Fe and unavoidable impurities, when the first hard particles have 100 mass %, the second hard particles contain 60 to 70 mass % of Mo, and 2.0 mass % or less of Si, and a remainder including Fe and unavoidable impurities, when the second hard particles have 100 mass %, and the mixed powder contains 5 to 50 mass % of the first hard particles, 1 to 8 mass % of the second hard particles, and 0.5 to 1.5 mass % of the graphite particles, when total mass of the first hard particles, the second hard particles, the graphite particles, and the iron particles is set as 100 mass %.

A second aspect of the present disclosure is a sintered-alloy compact including first hard particles containing 20 to 70 mass % of Mo, 5 to 40 mass % of Ni, 5 to 40 mass % of Co, 1 to 20 mass % of Mn, 0.5 to 4.0 mass % of Si, 0.5 to 3.0 mass % of C, and a remainder including Fe and unavoidable impurities, when the first hard particles have 100 mass %; second hard particles containing 60 to 70 mass % of Mo, 2.0 mass % or less of Si, and a remainder including Fe and unavoidable impurities, when the second hard particles have 100 mass %; graphite particles; and iron particles, wherein when total mass of the first hard particles, the second hard particles, the graphite particles, and the iron particles is set as 100 mass %, 5 to 50 mass % of the first hard particles, 1 to 8 mass % of the second hard particles, and 0.5 to 1.5 mass % of the graphite particles are included. A third aspect of the present disclosure is a sintered body of the formed body for a sintered alloy.

According to the present disclosure, machinability can be ensured while suppressing adhesive wear of a sintered alloy.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Figure 1:
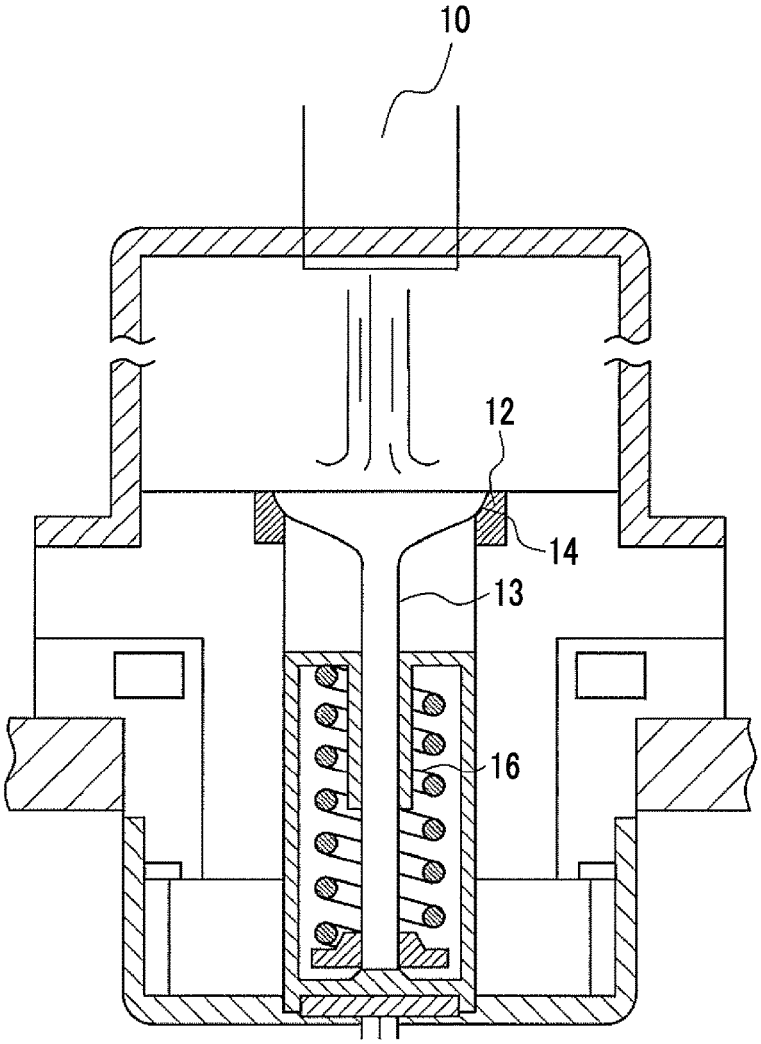
FIG. 1 is a schematic conceptual view of a wear test used in examples and comparative examples.

Hereinafter, an embodiment of the present disclosure will be described in detail.

A sintered-alloy compact (hereinafter, referred to as a compact) according to the embodiment is obtained by compacting mixed powder containing first hard particles, second hard particles, graphite particles, and iron particles, which will be described later. A wear-resistant iron-based sintered alloy (hereinafter, referred to as sintered alloy) is obtained by sintering the compact while causing carbon (C) of the graphite particles to diffuse into the hard particles and the iron particles. The hard particles, the compact obtained by compacting the mixed powder in which the hard particles are mixed, and the sintered alloy obtained by sintering the compact will be described below.

1. First Hard Particles

The first hard particles are particles which are mixed in the sintered alloy as the raw material and have a hardness higher than those of the iron particles and an iron-based base of the sintered alloy, and thus are particles for the purpose of suppressing abrasive wear of the sintered alloy.

The first hard particles are particles formed of a Co—Mo—Ni—Fe—Mn—Si—C-based alloy. Specifically, the first hard particles contain, when the amount of the first hard particles is assumed to be 100 mass %, 20 to 70 mass % of Mo, 5 to 40 mass % of Ni, 5 to 40 mass % of Co, 1 to 20 mass % of Mn, 0.5 to 4.0 mass % of Si, 0.5 to 3.0 mass % of C, and the remainder including Fe and unavoidable impurities. Furthermore, to the first hard particles, Cr may be added in a proportion in a range of 10 mass % or less as necessary.

The first hard particles may be produced by preparing molten metal in which the above-described components are mixed in the above-described proportions and performing an atomization process on the molten metal so as to be sprayed. In addition, as another method, a solidified body obtained by solidifying molten metal may be mechanically ground to be formed into a powder. The atomization process may be any of a gas atomization process and the water atomization process. However, in consideration of sintering properties, a gas atomization process in which round particles can be obtained is more preferable.

Here, the lower limits and upper limits of the components of the hard particles described above can be appropriately changed depending on the reason for limiting the components, which will be described later, and furthermore, in the ranges thereof, can be changed depending on the degree of emphasis on each of characteristics of members applied in consideration of solid lubricating properties, adhesiveness, costs, and the like.

1-1. Mo: 20 to 70 Mass %

Mo in the components of the first hard particles generates Mo carbides with C in carbon powder during sintering, thereby improving the hardness and wear resistance of the first hard particles. Furthermore, regarding Mo, Mo and Mo carbides solutionized in a high temperature use environment are oxidized and form Mo oxide films such that the sintered alloy can obtain favorable solid lubricating properties.

Here, a Mo content of less than 20 mass % causes not only a reduction in the amount of generated Mo carbides but also an increase in the oxidation start temperature of the first hard particles such that the generation of Mo oxides in the high temperature use environment is suppressed. Accordingly, the solid lubricating properties of the obtained sintered alloy become insufficient, and the abrasive wear resistance thereof decreases. On the other hand, a Mo content of more than 70 mass % causes not only a difficulty in production using an atomization method but also a reduction in the adhesiveness between the hard particles and the iron-based base. The Mo content is more preferably 30 to 50 mass %.

1-2. Ni: 5 to 40 Mass %

Ni in the components of the first hard particles increases the amount of an austenite structure in the base of the first hard particles, thereby improving the toughness thereof. In addition, Ni increases the amount of solutionized Mo in the first hard particles, thereby improving the wear resistance of the first hard particles.

Furthermore, Ni diffuses into the iron-based base of the sintered alloy during sintering and thus increases the amount of the austenitic structure of the iron-based base, thereby increasing the toughness of the sintered alloy. In addition, Ni increases the amount of solutionized Mo in the iron-based base, thereby improving wear resistance.

Here, when the Ni content is less than 5 mass %, the effects of Ni described above cannot be easily expected. On the other hand, when the Ni content is more than 40 mass %, the effects of Ni described above are saturated, resulting in an increase in the cost of the first hard particles. The Ni content is more preferably 20 to 40 mass %.

1-3. Co: 5 to 40 Mass %

Similarly to Ni, Co in the components of the first hard particles can increase the amount of the austenitic structure in the base of the first hard particles and the iron-based base of the sintered alloy and can improve the hardness of the first hard particles.

Here, when the Co content is less than 5 mass %, the effects of Co described above cannot be easily expected. On the other hand, when the Co content is more than 40 mass %, the effects of Co described above are saturated, resulting in an increase in the cost of the first hard particles. The Co content is more preferably 10 to 30 mass %.

1-4. Mn: 1 to 20 Mass %

Mn in the components of the first hard particles effectively diffuses into the iron-based base of the sintered alloy from the first hard particles during sintering, thereby improving the adhesiveness between the first hard particles and the iron-based base. Furthermore, Mn can increase the amount of the austenitic structure in the base of the first hard particles and the iron-based base of the sintered alloy.

Here, in a case where the Mn content is less than 1 mass %, the amount of Mn diffused into the iron-based base is small, resulting in a reduction in the adhesiveness between the hard particles and the iron-based base. Accordingly, the mechanical strength of the obtained sintered alloy decreases. On the other hand, when the Mn content is more than 20 mass %, the effects of Mn described above are saturated. The Mn content is more preferably 2 to 8 mass %.

1-5. Si: 0.5 to 4.0 Mass %

Si in the components of the first hard particles can improve the adhesiveness between the first hard particles and the Mo oxide films. Here, when the Si content is less than 0.5 mass %, the effects of Si described above cannot be easily expected. On the other hand, when the Si content is more than 4.0 mass %, formability into the compact is inhibited, and the density of the sintered alloy decreases. The Si content is more preferably 0.5 to 2 mass %.

1-6. C: 0.5 to 3.0 Mass %

C in the components of the first hard particles is bonded to Mo and forms Mo carbides, thereby improving the hardness and wear resistance of the first hard particles. Here, when the C content is less than 0.5 mass %, the effect of wear resistance is insufficient. On the other hand, when the C content is more than 3.0 mass %, formability into the compact is inhibited, and the density of the sintered alloy decreases. The C content is more preferably 0.5 to 2 mass %.

1-7. Cr: 10 Mass % or Less

Cr in the components of the first hard particles can suppress excessive oxidation of Mo during use. For example, in a case where the amount of Mo oxide films generated in the first hard particles increases due to a high use environment temperature of the sintered alloy and peeling of the Mo oxide films in the first hard particles occurs, the addition of Cr is effective.

Here, when the Cr content is more than 10 mass %, the formation of the Mo oxide films in the first hard particles is excessively suppressed. In addition, in a corrosive environment such as alcohol fuel, Cr may be added to improve corrosion resistance. On the other hand, in an environment in which adhesive wear easily occurs, the Cr content may be suppressed in order to accelerate oxidation.

1-8. Particle Size of First Hard Particles

The particle size of the first hard particles may be appropriately selected depending on the application and kind of the sintered alloy, and the particle size of the first hard particles is preferably in a range of 44 to 250 μm, and more preferably in a range of 44 to 105 μm.

Here, in a case where hard particles having a particle size of smaller than 44 μm are contained in the first hard particles, since the particle size thereof is too small, the wear resistance of the wear-resistant iron-based sintered alloy may be damaged. On the other hand, in a case where hard particles having a particle size of greater than 105 μm are contained in the first hard particles, since the particle size thereof is too great, the machinability of the wear-resistant iron-based sintered alloy may decrease.

2. Second Hard Particles

Like the first hard particles, the second hard particles are particles which are mixed in the sintered alloy as the raw material and have a hardness higher than those of the iron particles and the iron-based base of the sintered alloy. A small amount of the second hard particles added significantly increases the hardness of the sintered alloy, thereby suppressing plastic deformation of the iron-based base of the sintered alloy. As a result, the second hard particles are particles for the purpose of reducing the adhesive wear of the sintered alloy.

The second hard particles are particles made of an Fe—Mo-based alloy, and contain, when the amount of the second hard particles is assumed to be 100 mass %, 60 to 70 mass % of Mo, 2.0 mass % or less of Si, and the remainder including Fe and unavoidable impurities.

The second hard particles are produced by mechanically grinding a solidified body obtained by solidifying molten metal to be formed into a powder. In addition, like the first hard particles, the second hard particles may be produced by a gas atomization process, a water atomization process, or the like.

2-1. Mo: 60 to 70 Mass %

Mo in the components of the second hard particles generates Mo carbides with C in carbon powder during sintering, thereby improving the hardness and wear resistance of the second hard particles. Furthermore, regarding Mo, Mo and Mo carbides solutionized in a high temperature use environment are oxidized and form Mo oxide films such that the sintered alloy can obtain favorable solid lubricating properties. Furthermore, by causing Mo carbides to be precipitated to the grain boundaries of the iron-based base during sintering, plastic deformation of the iron-based base during use is suppressed, and adhesive wear can be suppressed.

When the Mo content is less than 60 mass %, it is difficult to suppress plastic deformation of the iron-based base due to the Mo carbides described above, and adhesive wear resistance decreases. On the other hand, when the Mo content is more than 70 mass %, production by a grinding method is difficult, resulting in a reduction in the yield thereof.

2-2. Si: 2.0 Mass % or Less

In a case where Si is included in the components of the second hard particles, the second hard particles are easily produced by a grinding method. Here, when the Si content is more than 2.0 mass %, the hardness of the second hard particles increases, and formability into the compact is inhibited, resulting in not only a reduction in the density of the sintered alloy but also a reduction in the machinability of the sintered alloy.

2-3. Particle Size of Second Hard Particles

The particle size of the second hard particles may be appropriately selected depending on the application and kind of the sintered alloy, and the particle size (maximum particle size) of the second hard particles is preferably in a range of 75 μm or smaller. Accordingly, the second hard particles can be uniformly dispersed by the base, and the hardness of the sintered alloy can be increased. Here, in a case where hard particles having a particle size of greater than 75 μm are contained in the second hard particles, since the particle size thereof is too great, the machinability of the sintered alloy may decrease. In addition, the particle size of the second hard particles is preferably 1 μm or greater from the viewpoint of production.

3. Graphite Particles

The graphite particles may be graphite particles of any of natural graphite and artificial graphite or a mixture thereof as long as C of the graphite particles can diffuse into the iron-based base and the hard particles as a solid solution during sintering. The particle size of the graphite particles is preferably in a range of 1 to 45 μm. As a powder formed of preferable graphite particles, graphite powder (CPB-S: manufactured by Nippon Graphite Industries, Co., Ltd.) or the like may be employed.

4. Iron Particles

The iron particles as the base of the sintered alloy are formed of iron particles primarily containing Fe. A powder formed of the iron particles is preferably pure iron powder and may also be low alloy steel powder in a range in which the diffusion of elements such as Mn of the first hard particles described above is not inhibited without inhibition of formability during compaction. As the low alloy steel powder, an Fe—C-based powder may be employed. For example, when the amount of the low alloy steel powder is assumed to be 100 mass %, a power having a composition including C: 0.2 to 5 mass % and the remainder including unavoidable impurities and Fe may be employed. In addition, this powder may also be gas atomized powder, water atomized powder, or reduced powder. The particle size of the iron particles is preferably in a range of 150 μm or smaller.

5. Mixing Ratio of Mixed Powder

The mixed powder is produced to contain the first hard particles, the second hard particles, the graphite particles, and the iron particles. When the total amount of the first hard particles, the second hard particles, the graphite particles, and the iron particles is assumed to be 100 mass %, the mixed powder contains 5 to 50 mass % of the first hard particles, 1 to 8 mass % of the second hard particles, and 0.5 to 1.5 mass % of the graphite particles.

The mixed powder may be formed of the first hard particles, the second hard particles, the graphite particles, and the iron particles, and may contain another kind of particles in a proportion of several mass % on the assumption that the mechanical strength and wear resistance of the obtained sintered alloy are not inhibited. In this case, when the total amount of the first and second hard particles, the graphite particles, and the iron particles is 95 mass % or more with respect to the mixed powder, the effects thereof can be sufficiently expected. For example, the mixed powder may also contain at least one kind of particles for improving machinability selected from the group consisting of sulfides (for example MnS), oxides (for example, $CaCO_3$), fluorides (for example, CaF), nitrides (for example BN), and oxysulfides.

Since the first hard particles are included in a proportion of 5 to 50 mass % with respect to the total amount of the first hard particles, the second hard particles, the graphite particles, and the iron particles, both the mechanical strength and abrasive wear resistance of the sintered alloy can be improved.

Here, in a case where the amount of the first hard particles is less than 5 mass % with respect to the total amount, as is apparent from experiments conducted by the inventors, which will be described later, the effect of abrasive wear resistance by the first hard particles cannot be sufficiently exhibited.

On the other hand, in a case where the amount of the first hard particles is more than 50 mass % with respect to the total amount, since the amount of the first hard particles is too great, it is difficult to form the mixed powder into the compact when the compact is to be formed. In addition, contact between the first hard particles increases, and portions where the iron particles are sintered together decrease. Accordingly, the abrasive wear resistance of the sintered alloy decreases.

Since the second hard particles are included in a proportion of 1 to 8 mass % with respect to the total amount of the first hard particles, the second hard particles, the graphite particles, and the iron particles, as described above, plastic deformation of the iron-based base during use is suppressed, and the adhesive wear of the sintered alloy can be reduced.

Here, in a case where the amount of the second hard particles is less than 1 mass % with respect to the total amount, as is apparent from experiments conducted by the inventors, which will be described later, the adhesive wear resistance of the sintered alloy decreases. On the other hand, in a case where the amount of the second hard particles is more than 8 mass % with respect to the total amount, as is apparent from experiments conducted by the inventors, which will be described later, the machinability of the sintered alloy decreases.

Since the graphite particles are included in a proportion of 0.5 to 1.5 mass % with respect to the total amount of the first hard particles, the second hard particles, the graphite particles, and the iron particles, C of the graphite particles can diffuse into the first hard particles and the second hard particles as a solid solution without the first hard particles and the second hard particles being melted after sintering. In addition, a pearlitic stricture in the iron-based base can be ensured. Accordingly, both the mechanical strength and wear resistance of the sintered alloy can be improved.

Here, in a case where the amount of the graphite particles is less than 0.5 mass % with respect to the total amount, the amount of a ferritic structure in the iron-based base tends to increase. Accordingly, the strength of the iron-based base itself of the sintered alloy decreases. On the other hand, in a case where the amount of the graphite particles is more than 1.5 mass % with respect to the total amount, a cementite structure precipitates, and the machinability of the sintered alloy decreases.

6. Production Method of Wear-Resistant Iron-Based Sintered Alloy

The mixed powder obtained as described above is compacted into a sintered-alloy compact. In the sintered-alloy compact, the first hard particles, the second hard particles, the graphite particles, and the iron particles are included in the same proportions as those in the mixed powder.

The sintered-alloy compact, which is compacted, is sintered while causing C of the graphite particles of the sintered-alloy compact to diffuse into the first hard particles, the second hard particles, and the iron particles, thereby producing a wear-resistant iron-based sintered alloy. At this time, not only does the degree of diffusion of iron from the iron-based base (iron particles) into the first hard particles and the second hard particles increase, but also carbon of the graphite particles easily diffuses into the second hard particles because the second hard particles does not contain carbon. In addition, Mo carbides are generated in the grain boundaries of the second hard particles, and thus the hardness of the sintered alloy can be increased.

As a sintering temperature, a temperature of about 1050° C. to 1250° C., and particularly about 1100° C. to 1150° C. may be employed. At the sintering temperature described above, as a sintering time, a time of 30 minutes to 120 minutes, and more preferably 45 minutes to 90 minutes may be employed. As a sintering atmosphere, a non-oxidizing atmosphere such as an inert gas atmosphere may be employed. As the inert gas atmosphere, a nitrogen gas atmosphere, an argon gas atmosphere, or a vacuum atmosphere may be employed.

In order to ensure hardness, the base of the iron-based sintered alloy obtained through sintering preferably includes a structure including pearlite, and the structure including pearlite may be a pearlitic structure, a pearlite-austenite-based mixed structure, or a pearlite-ferrite-based mixed structure. In order to ensure wear resistance, the amount of ferrite with low hardness is preferably as low as possible.

According to the method described above, a sintered alloy containing Mo: 1.6 to 40.6 mass %, Ni: 0.25 to 20 mass %, Co: 0.25 to 20 mass %, Cr: 5% mass % or less, Mn: 0.05 to 10 mass %, Si: 0.025 to 2 mass %, C: 0.025 to 3.0 mass %, and the remainder including iron and unavoidable impurities can be obtained.

7. Application of Wear-Resistant Iron-Based Sintered Alloy

The sintered alloy obtained in the production method described above has higher mechanical strength and higher wear resistance than those in the related art in a high temperature use environment. For example, the sintered alloy can be appropriately used for a valve system of an internal combustion engine (for example, a valve seat or valve guide) which uses compressed natural gas or liquefied petroleum gas as the fuel and is subjected to a high temperature use environment, and a wastegate valve of a turbocharger.

For example, in a case where a valve seat of an exhaust valve of an internal combustion engine is formed of the sintered alloy, even when a form of wear in which adhesive wear during contact between the valve seat and the valve and abrasive wear during sliding of the two are mixed is exhibited, the wear resistance of the valve seat can be further improved compared to the related art. Particularly, in a use environment in which compressed natural gas or liquefied petroleum gas is used as the fuel, Mo oxide films are less likely to be formed. However, even in this environment, the adhesive wear can be reduced.

Hereinafter, examples and comparative examples for specifically embodying the present disclosure will be described.

Example 1: Optimal Addition Amount of First Hard Particles

In a production method described below, a sintered alloy according to Example 1 was produced. As first hard particles, hard particles (manufactured by Daido Steel Co., Ltd) produced by a gas atomization method from an alloy containing Mo: 40 mass %, Ni: 30 mass %, Co: 20 mass %, Mn: 5 mass %, Si: 0.8 mass %, C: 1.2 mass %, and the remainder including Fe and unavoidable impurities (that is, Fe-40Mo-30Ni-20Co-5Mn-0.8Si-1.2C) were prepared. The first hard particles were classified to be in a range of 44 μm to 250 μm by using a sieve based on JIS Z 8801. In addition, the "grain size of particles" mentioned in the specification is a value classified in this method.

As second hard particles, second hard particles (manufactured by Kinsei Matec Co., Ltd.) produced by a grinding method from an Fe-65 alloy containing Mo: 65 mass % and the remainder including Fe and unavoidable impurities were prepared. The second hard particles were classified to be 75 μm or smaller.

Next, graphite powder (CPB-S: manufactured by Nippon Graphite Industries, Co., Ltd.) formed of graphite particles, and reduced iron powder (JIP 255M-90: manufactured by JFE Steel Corporation) formed of pure iron particles were prepared. 5 mass % of the first hard particles, 3 mass % of the second hard particles, 1.1 mass % of the graphite particles, and the iron particles as the remainder (specifically, 90.9 mass %), which are described above, were mixed in this ratio in a V-type mixture for 30 minutes, thereby obtaining mixed powder.

Next, the mixed powder obtained using a forming die was compacted into a specimen having a ring shape with a pressing force of 784 MPa, thereby forming a sintered-alloy compact (compact). The compact was sintered in an inert atmosphere (nitrogen gas atmosphere) at 1120° C. for 60 minutes, thereby forming a specimen of the sintered alloy (valve seat) according to Example 1.

Examples 2 and 3: Optimal Addition Amount of First Hard Particles

Specimens of sintered alloys were produced in the same manner as in Example 1. Examples 2 and 3 are examples for evaluating the optimal addition amount of the first hard particles. Examples 2 and 3 are different from Example 1 in that the first hard particles were added sequentially in proportions of 40 mass % and 50 mass % with respect to the total amount of the mixed powder as shown in Table 1.

Example 4

A specimen of a sintered alloy was produced in the same manner as that in Example 2. Example 4 is an example in which Cr was added as a new element to the components of first hard particles. Example 4 is different from Example 2 in that hard particles produced by a gas atomization method from an alloy containing Mo: 34 mass %, Ni: 10 mass %, Co: 31 mass %, Cr: 3.7 mass %, Mn: 6 mass %, Si: 0.9 mass %, C: 1.0 mass %, and the remainder including Fe and unavoidable impurities (that is, Fe-34Mo-10Ni-31Co-3.7Cr-6Mn-0.9Si-1.0C) were used as the first hard particles.

Examples 5 to 7

A specimen of a sintered alloy was produced in the same manner as that in Example 2. Examples 5 to 7 are examples in which the addition amounts of the components of first hard particles were changed.

Example 5 is different from Example 2 in that hard particles produced by a gas atomization method from an alloy containing Mo: 70 mass %, Ni: 5 mass %, Co: 5 mass %, Mn: 2 mass %, Si: 0.8 mass %, C: 1.2 mass %, and the remainder including Fe and unavoidable impurities (that is, Fe-70Mo-5Ni-5Co-2Mn-0.8Si-1.2C) were used as the first hard particles.

Example 6 is different from Example 2 in that hard particles produced by a gas atomization method from an alloy containing Mo: 20 mass %, Ni: 40 mass %, Co: 5 mass %, Mn: 6 mass %, Si: 0.8 mass %, C: 1.2 mass %, and the remainder including Fe and unavoidable impurities (that is, Fe-20Mo-40Ni-5Co-6Mn-0.8Si-1.2C) were used as the first hard particles.

Example 7 is different from Example 2 in that hard particles produced by a gas atomization method from an alloy containing Mo: 20 mass %, Ni: 5 mass %, Co: 40 mass %, Mn: 6 mass %, Si: 0.8 mass %, C: 1.2 mass %, and the remainder including Fe and unavoidable impurities (that is, Fe-20Mo-5Ni-40Co-6Mn-0.8Si-1.2C) were used as the first hard particles.

Comparative Example 1

A specimen of a sintered alloy was produced in the same manner as that in Example 2. The difference from Example 1 is that particles formed of a Co-40Mo-5Cr-0.9C alloy corresponding to hard particles described in JP 2004-156101 A were used as first hard particles, and second hard particles were not added.

Comparative Examples 2 and 3: Comparative Examples of Optimal Addition Amount of First Hard Particles Specimens of sintered alloys were produced in the same manner as that in Example 1. Comparative Examples 2 and 3 are comparative examples for evaluating the optimal addition amount of the first hard particles. Comparative Examples 2 and 3 are different from Example 1 in that the first hard particles were added sequentially in proportions of 0 mass % (that is, not added) and 60 mass % with respect to the total amount of the mixed powder as shown in Table 1. In addition, in Comparative Example 3, a compact could not be formed from the mixed powder.

Wear Test

Using a tester of FIG. 1, a wear test was conducted on the specimens of the sintered alloys according to Examples 1 to 7 and Comparative Examples 1 and 2 to evaluate the wear resistance thereof. In this test, as shown in FIG. 1, by using a propane gas burner 10 as a heating source, sliding portions of a ring-shaped valve seat 12, which was formed of the sintered alloy produced as described above, and a valve face 14 of a valve 13 were subjected to a propane gas combustion atmosphere. The valve face 14 was subjected to a soft nitriding process according to EV12 (SAE standards). The wear test was conducted for 8 hours by controlling the temperature of the valve seat 12 to 250° C., applying a load of 25 kgf during contact between the valve seat 12 and the valve face 14 using a spring 16, and causing the valve seat 12 and the valve face 14 to come into contact with each other at a rate of 3250 times/min.

Figure 3A:
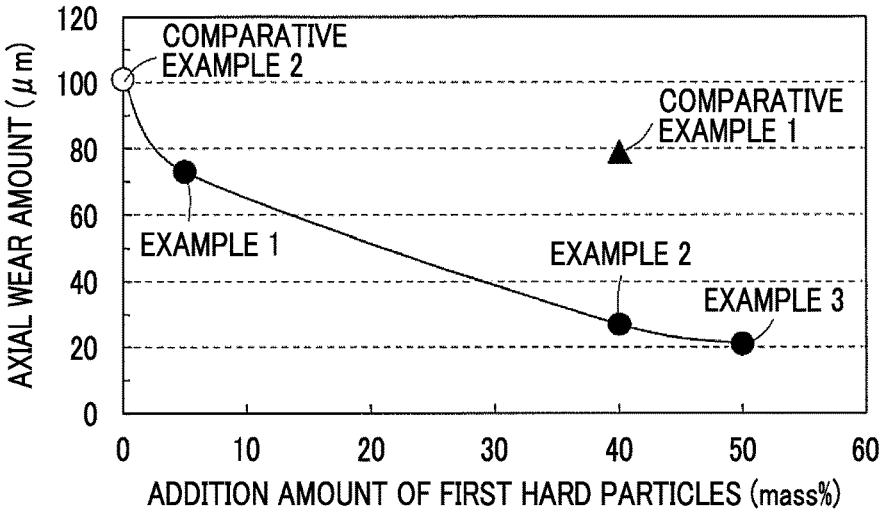
FIG. 3A is a graph showing results of axial wear amounts of Examples 1 to 3 and Comparative Examples 1 and 2 after the wear test.

The total amount of axial depths of wear of the valve seat 12 and the valve face 14 after the wear test was measured as an axial wear amount. The results are shown in Table 1 and FIG. 3A. FIG. 3A is a graph showing results of the axial wear amount after the wear test conducted on Examples 1 to 3 and Comparative Examples 1 and 2.

Figure 4A:
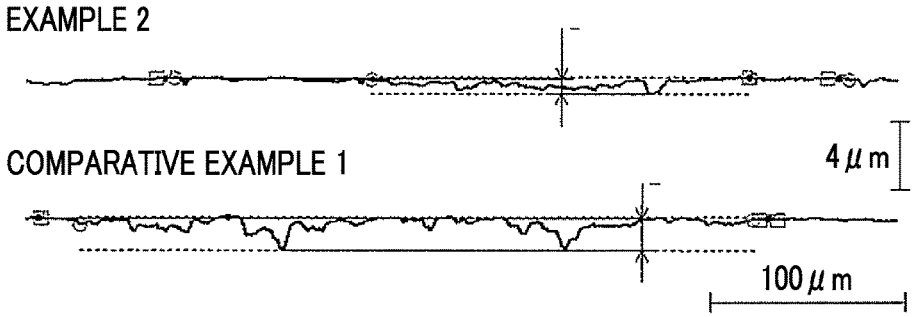
FIG. 4A shows surface profiles of specimens according to Example 2 and Comparative Example 1 after the wear test.
Figure 4B:
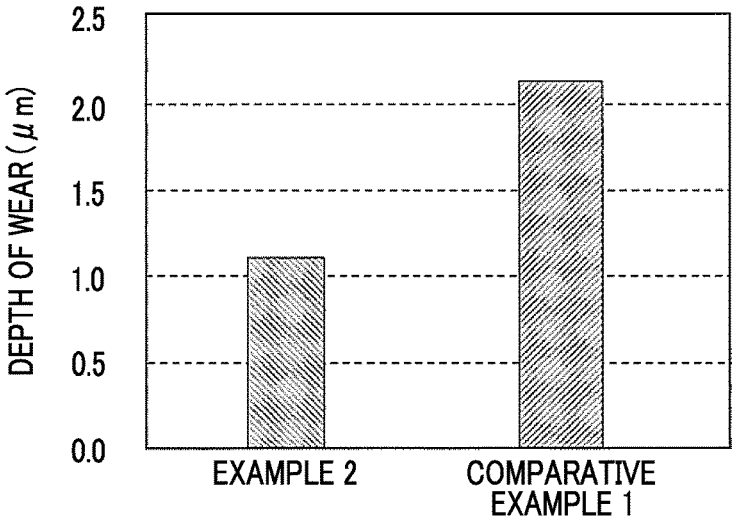
FIG. 4B is a graph showing results of depths of wear of the specimens of Example 2 and Comparative Example 1.

Furthermore, the above-described wear test was conducted on the specimens according to Example 2 and Comparative Example 1 at a temperature of 200° C. at which the surface of the specimen was less likely to be oxidized. The surface profiles of Example 2 and Comparative Example 1 were measured after the wear test, and the depths of wear were measured from the measured surface profiles. The results are shown in FIGS. 4A and 4B. FIG. 4A shows the surface profiles of the specimens of Example 2 and Comparative Example 1 after the wear test, and FIG. 4B is a graph showing the results of the depths of wear of the specimens of Example 2 and Comparative Example 1.

Machinability Test

Figure 2:
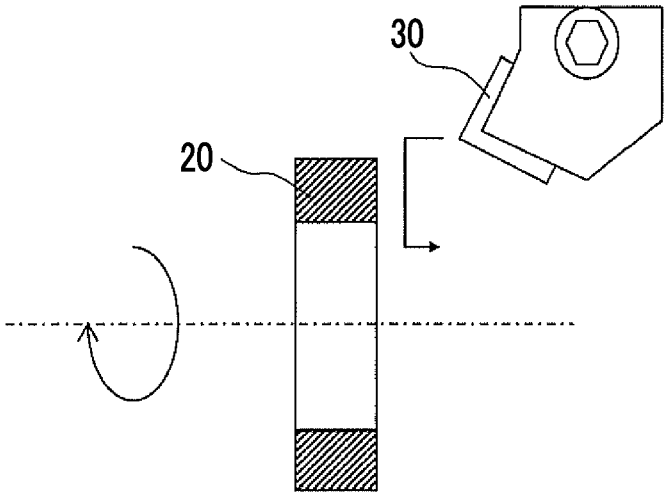
FIG. 2 is a schematic conceptual view of a machinability test used in the examples and the comparative examples.

Using a tester shown in FIG. 2, a machinability test was conducted on the specimens of the sintered alloys according to Examples 1 to 7 and Comparative Examples 1 and 2 to evaluate the machinability thereof. In this test, six specimens 20 having an outer diameter of 30 mm, an inner diameter of 22 mm, and an overall length of 9 mm were prepared for each of Examples 1 to 7 and Comparative Examples 1 and 2. Using an NC lathe, the specimen 20 rotated at a rotation speed of 970 rpm was subjected to wet traverse cutting with a depth of cut of 0.3 mm, a feed of 0.08 mm/rev, and a cutting distance of 320 m by a carbide cutting tool 30 coated with titanium aluminum nitride.

Figure 3B:
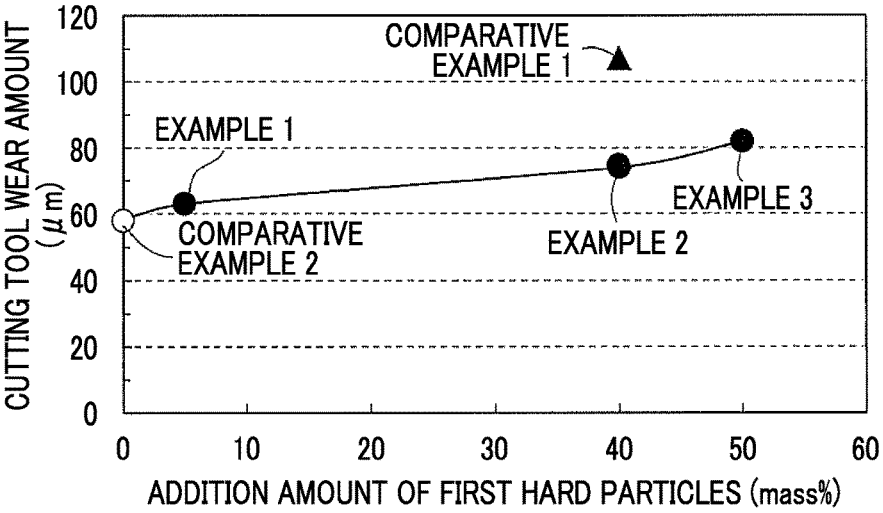
FIG. 3B is a graph showing results of cutting tool wear amounts after the machinability test in Examples 1 to 3 and Comparative Examples 1 and 2.

Thereafter, the maximum depth of wear of the flank face of the cutting tool 30 was measured by an optical microscope as a cutting tool wear amount. The results are shown in Table 1 and FIG. 3B. FIG. 3B is a graph showing the results of the cutting tool wear amounts of Examples 1 to 3 and Comparative Examples 1 and 2 after the machinability test.

TABLE 1

| | First hard particles | | Second hard particles | | | Graphite particles |
|---|---|---|---|---|---|---|
| | Components | Addition amount (mass %) | Components | Particle size (μm) | Addition amount (mass %) | Addition amount (mass %) |
| Comparative Example 1 | Co—40Mo—5Cr—0.9C | 40 | | Absent | | 1.1 |
| Comparative Example 2 | Fe—40Mo—30Ni—20Co—5Mn—0.8Si—1.2C | 0 | FeMo | ~75 | 3 | 1.1 |
| Example 1 | Fe—40Mo—30Ni—20Co—5Mn—0.8Si—1.2C | 5 | FeMo | ~75 | 3 | 1.1 |
| Example 2 | Fe—40Mo—30Ni—20Co—5Mn—0.8Si—1.2C | 40 | FeMo | ~75 | 3 | 1.1 |
| Example 3 | Fe—40Mo—30Ni—20Co—5Mn—0.8Si—1.2C | 50 | FeMo | ~75 | 3 | 1.1 |
| Comparative Example 3 | Fe—40Mo—30Ni—20Co—5Mn—0.8Si—1.2C | 60 | FeMo | ~75 | 3 | 1.1 |
| Example 4 | Fe—34Mo—10Ni—31Co—3.7Cr—6Mn—0.9Si—1.0C | 40 | FeMo | ~75 | 3 | 1.1 |
| Example 5 | Fe—70Mo—5Ni—5Co—2Mn—0.8Si—1.2C | 40 | FeMo | ~75 | 3 | 1.1 |
| Example 6 | Fe—20Mo—40Ni—5Co—6Mn—0.8Si—1.2C | 40 | FeMo | ~75 | 3 | 1.1 |
| Example 7 | Fe—20Mo—5Ni—40Co—6Mn—0.8Si—1.2C | 40 | FeMo | ~75 | 3 | 1.1 |

| | Sintered body Components (mass %) | Wear resistance Wear amount (μm) | Machinability Cutting tool wear amount (μm) |
|---|---|---|---|
| Comparative Example 1 | Fe—16.0Mo—21.0Co—2.4Mn—1.1C | 79 | 107 |
| Comparative Example 2 | Fe—2.0Mo—0.03Si—1.0C | 101 | 58 |
| Example 1 | Fe—4.0Mo—1.5Ni—1.0Co—0.2Cr—0.3Mn—0.07Si—1.1C | 73 | 63 |
| Example 2 | Fe—18.0Mo—12.0Ni—8.0Co—2.0Mn—0.35Si—1.5C | 27 | 74 |
| Example 3 | Fe—22.0Mo—15.0Ni—10.0Co—1.9Mn—0.430Si—1.6C | 21 | 82 |
| Comparative Example 3 | Fe—26.0Mo—18.0Ni—12.0Co—2.2Mn—0.51Si—1.7C | Unable to be formed | Unable to be formed |
| Example 4 | Fe—15.6Mo—4.0Ni—12.4Co—1.5Cr—2.4Mn—0.36Si—1.4C | 25 | 75 |
| Example 5 | Fe—30.0Mo—2.0Ni—2.0Co—0.8Mn—0.35Si—1.5C | 22 | 79 |
| Example 6 | Fe—10.0Mo—16.0Ni—2.0Co—2.4Mn—0.35Si—1.5C | 32 | 72 |
| Example 7 | Fe—10.0Mo—2.0Ni—16.0Co—2.4Mn—0.35Si—1.5C | 30 | 77 |

Results 1: Optimal Addition Amount of First Hard Particles

As shown in FIG. 3A, the axial wear amounts of Examples 1 to 3 were smaller than those of Comparative Examples 1 and 2. The axial wear amounts decreased in order of Example 1, Example 2, and Example 3. In addition, as shown in Table 1, the Example 4 in which the components and addition amount of the first hard particles were changed from those of Example 2, and Examples 5 to 7 in which the addition amounts thereof were changed had the same degree of axial wear amount. From this, it is thought that by adding the first hard particles, the abrasive wear resistance of the sintered alloy was improved. However, it can be said that since the first hard particles were excessively added in Comparative Example 3, formability into a compact was inhibited. From these points, the addition amount of the first hard particles is preferably 5 to 50 mass % with respect to the mixed powder.

In addition, as shown in FIG. 3B, the cutting tool wear amounts of Examples 1 to 3 were smaller than that of Comparative Example 1, and the cutting tool wear amount increased in order of Example 1, Example 2, and Example 3. In addition, as shown in Table 1, Example 2, Example 4 in which the elements added to the first hard particles and the addition amounts thereof were changed from those of Example 2, and Examples 5 to 7 in which the addition amounts thereof were changed had the same degree of cutting tool wear amount. From this, there are small changes in the axial wear amount and the cutting tool wear amount in the ranges of the components of the first hard particles shown in Examples 5 to 7.

In addition, in the wear test conducted in an environment at a temperature of 200° C., as shown in FIG. 4A, plucked parts were present in the surface profile of the specimen of Comparative Example 1, and adhesive wear was confirmed. However, in the surface profile of the specimen of Example 2, there were substantially no plucked parts. It is thought that this is caused by the addition of the second hard particles to the specimen of Example 2, and this was confirmed in Examples 8 to 10 and Comparative Examples 4 and 5 described below.

Examples 8 to 10: Optimal Addition Amount of Second Hard Particles

Specimens of sintered alloys were produced in the same manner as in Example 2. Examples 8 to 10 are examples for evaluating the optimal addition amount of the second hard particles. Examples 8 to 10 are different from Example 2 in that the second hard particles were added sequentially in proportions of 1 mass %, 3 mass %, and 8 mass % with respect to the total amount of the mixed powder as shown in Table 2. In addition, Example 9 was the same as Example 2 described above.

Comparative Examples 4 and 5: Comparative Examples of Optimal Addition Amount of Second Hard Particles A specimen of a sintered alloy was produced in the same manner as that in Example 8. Comparative Examples 4 and 5 are comparative examples for evaluating the optimal addition amount of the second hard particles. Comparative Examples 4 and 5 are different from Example 8 in that the second hard particles were added sequentially in proportions of 0 mass % and 10 mass % with respect to the total amount of the mixed powder as shown in Table 2.

Figure 5A:
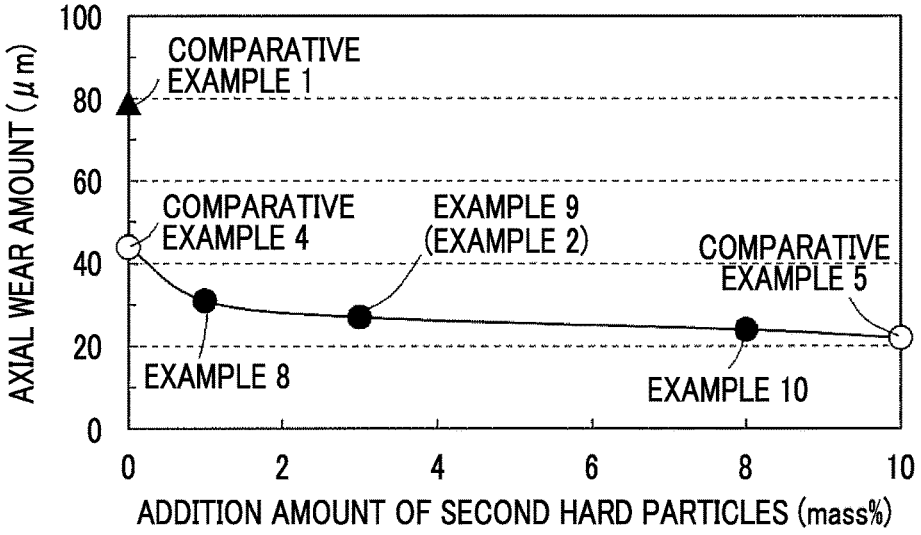
FIG. 5A is a graph showing results of axial wear amounts of Examples 8 to 10 and Comparative Examples 1, 4, and 5 after the wear test.

In the same manner as in Example 1, a wear test was conducted on the specimens of Examples 8 to 10 and Comparative Examples 4 and 5, and the axial wear amounts thereof after the wear test were measured. The results are shown in Table 2 and FIG. 5A. FIG. 5A is a graph showing the results of the axial wear amounts of Examples 8 to 10 and Comparative Examples 1, 4, and 5 after the wear test, and in FIG. 5A, the result of Comparative Example 1 described above was also shown.

Figure 6A:
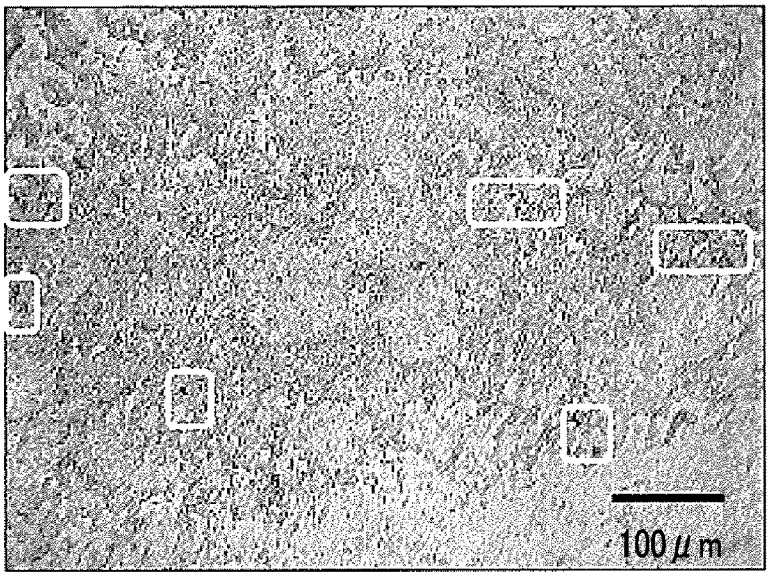
FIG. 6A is a surface photograph of a specimen according to Example 8 after the wear test.
Figure 6B:
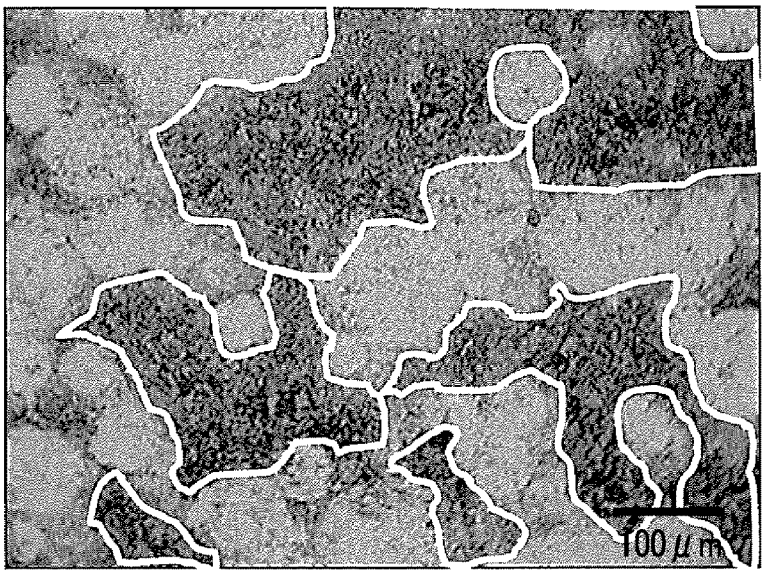
FIG. 6B is a surface photograph of a specimen according to Comparative Example 4 after the wear test.

Furthermore, the surfaces of the specimens according to Example 8 and Comparative Example 4 after the wear test were observed by a microscope. The results are shown in FIGS. 6A and 6B. FIG. 6A is a surface photograph of the specimen according to Example 8 after the wear test, and FIG. 6B is a surface photograph of the specimen according to Comparative Example 4 after the wear test.

Figure 5B:
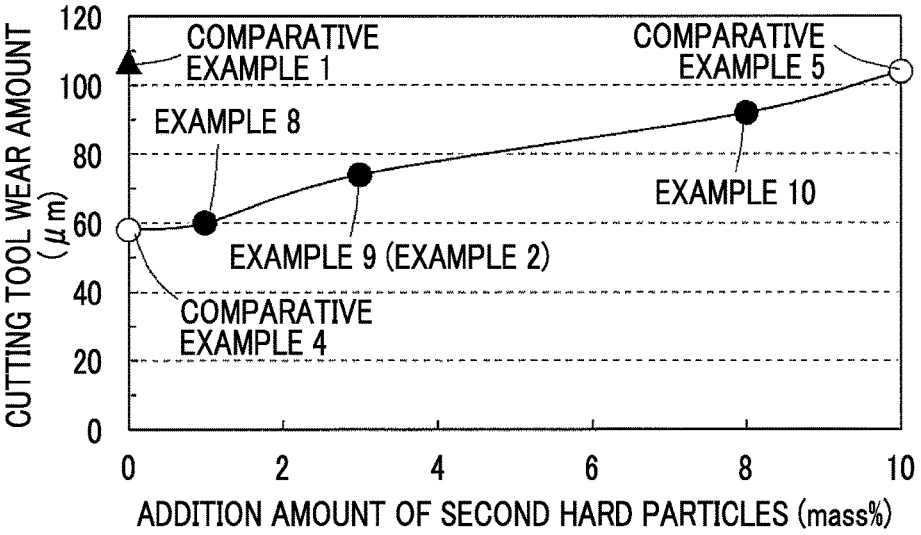
FIG. 5B is a graph showing results of cutting tool wear amounts of Examples 8 to 10 and Comparative Examples 1, 4, and 5 after the machinability test.

In the same manner as in Example 1, a machinability test was conducted on the specimens of Examples 8 to 10 and Comparative Examples 4 and 5, and the cutting tool wear amounts thereof after the machinability test were measured. The results are shown in Table 2 and FIG. 5B. FIG. 5B is a graph showing the results of the cutting tool wear amounts of Examples 8 to 10 and Comparative Examples 1, 4, and 5 after the machinability test, and in FIG. 5B, the result of Comparative Example 1 described above was also shown.

TABLE 2

| | First hard particles | | Second hard particles | | | Graphite particles |
|---|---|---|---|---|---|---|
| | Components | Addition amount (mass %) | Components | Particle size (μm) | Addition amount (mass %) | Addition amount (mass %) |
| Comparative Example 4 | Fe—40Mo—30Ni—20Co—5Mn—0.8Si—1.2C | 40 | FeMo | ~75 | 0 | 0.8 |
| Example 8 | Fe—40Mo—30Ni—20Co—5Mn—0.8Si—1.2C | 40 | FeMo | ~75 | 1 | 1.1 |
| Example 9 | Fe—40Mo—30Ni—20Co—5Mn—0.8Si—1.2C | 40 | FeMo | ~75 | 3 | 1.1 |
| Example 10 | Fe—40Mo—30Ni—20Co—5Mn—0.8Si—1.2C | 40 | FeMo | ~75 | 8 | 1.1 |
| Comparative Example 5 | Fe—40Mo—30Ni—20Co—5Mn—0.8Si—1.2C | 40 | FeMo | ~75 | 10 | 1.1 |

| | Sintered body Components (mass %) | Wear resistance Wear amount (μm) | Machinability Cutting tool wear amount (μm) |
|---|---|---|---|
| Comparative Example 4 | Fe—16.0Mo—12.0Ni—8.0Co—2.0Mn—0.32Si—1.2C | 44 | 58 |
| Example 8 | Fe—16.7Mo—12.0Ni—8.0Co—2.0Mn—0.35Si—1.5C | 31 | 60 |
| Example 9 | Fe—18.0Mo—12.0Ni—8.0Co—2.0Mn—0.35Si—1.5C | 27 | 74 |
| Example 10 | Fe—21.2Mo—12.0Ni—8.0Co—2.0Mn—0.40Si—1.5C | 24 | 92 |
| Comparative Example 5 | Fe—22.5Mo—12.0Ni—8.0Co—2.0Mn—0.42Si—1.5C | 22 | 104 |

Results 2: Optimal Addition Amount of Second Hard Particles

As shown in FIG. 5A, the axial wear amounts of Examples 8 to 10 and Comparative Example 5 were smaller than those of Comparative Examples 1 and 4. The axial wear amounts decreased in order of Example 8, Example 9, Example 10, and Comparative Example 5. However, as shown in FIG. 5B, the cutting tool wear amount of Comparative Example 5 was greater than those of Examples 8 to 10.

In Example 8, plucked marks caused by adhesive wear were slightly present in portions of parts surrounded by white lines shown in FIG. 6A. On the other hand, in Comparative Example 4, plucked marks caused by adhesive wear were formed over the entire black parts surrounded by white lines shown in FIG. 6B.

From this, it is thought that the second hard particles improved the hardness of the sintered alloy after sintering, suppressed plastic deformation of the iron-based base of the sintered alloy during use, and thus reduced adhesive wear of the sintered alloy. Specifically, it is thought that since the second hard particles did not contain Ni, Co, and the like unlike the first hard particles, the second hard particles could cause the iron-based base to be harder than the first hard particles, and by causing Mo carbides to precipitate to the grain boundaries of the iron-based base during sintering, the hardness of the iron-based base after sintering was improved. In addition, it is thought that when the second hard particles were excessively added as in Comparative Example 5, the sintered alloy after sintering became excessively hard, resulting in a reduction in machinability. From the above-described results, the optimal addition amount of the second hard particles is 1 to 8 mass % with respect to the mixed powder.

Examples 11 to 13: Optimal Addition Amount of Graphite Particles

Specimens of sintered alloys were produced in the same manner as in Example 2. Examples 11 to 13 are examples for evaluating the optimal addition amount of the graphite particles. Examples 11 to 13 are different from Example 2 in that the graphite particles were added sequentially in proportions of 0.5 mass %, 1.1 mass %, and 1.5 mass % with respect to the total amount of the mixed powder as shown in Table 3. In addition, Example 12 is the same as Example 2 described above.

Comparative Examples 6 and 7: Comparative Examples of Optimal Addition Amount of Graphite Particles Specimens of sintered alloys were produced in the same manner as that in Example 11. Comparative Examples 6 and 7 are comparative examples for evaluating the optimal addition amount of the graphite particles. Comparative Examples 6 and 7 are different from Example 11 in that the graphite particles were added sequentially in proportions of 0.4 mass % and 1.6 mass % with respect to the total amount of the mixed powder as shown in Table 3.

Figure 7A:
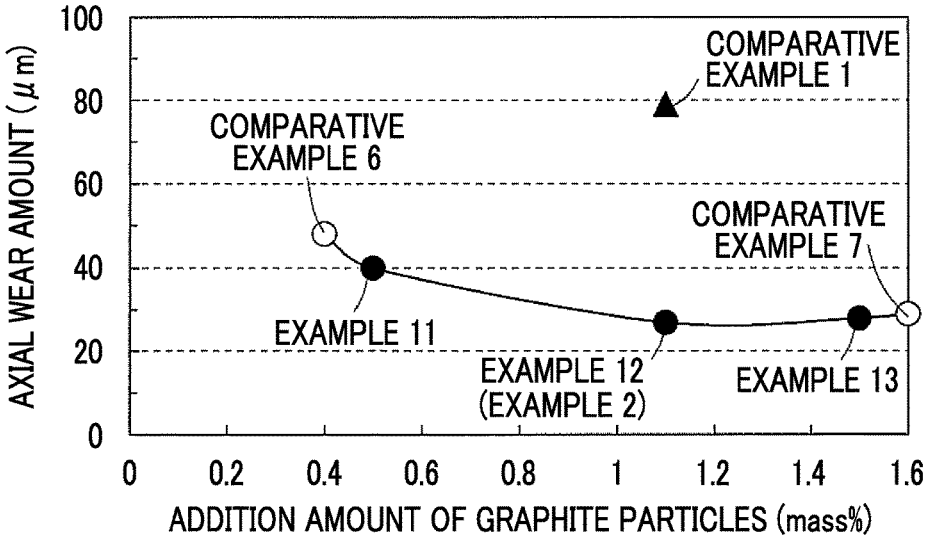
FIG. 7A is a graph showing results of axial wear amounts of Examples 11 to 13 and Comparative Examples 1, 6, and 7 after the wear test.

In the same manner as in Example 1, a wear test was conducted on the specimens of Examples 11 to 13 and Comparative Examples 6 and 7, and the axial wear amounts thereof after the wear test were measured. The results are shown in Table 3 and FIG. 7A. FIG. 7A is a graph showing the results of the axial wear amounts of Examples 11 to 13 and Comparative Examples 1, 6, and 7 after the wear test, and in FIG. 7A, the result of Comparative Example 1 described above was also shown.

Figure 7B:
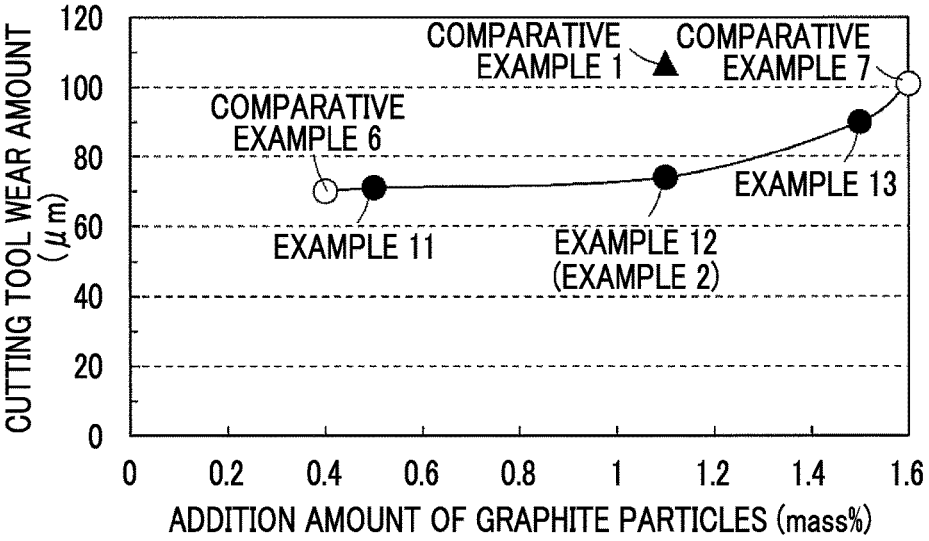
FIG. 7B is a graph showing results of cutting tool wear amounts of Examples 11 to 13 and Comparative Examples 1, 6, and 7 after the machinability test.

In the same manner as in Example 1, a machinability test was conducted on the specimens of Examples 11 to 13 and Comparative Examples 6 and 7, and the cutting tool wear amounts thereof after the machinability test were measured. The results are shown in Table 3 and FIG. 7B. FIG. 7B is a graph showing the results of the cutting tool wear amounts of Examples 11 to 13 and Comparative Examples 1, 6, and 7 after the machinability test, and in FIG. 7B, the result of Comparative Example 1 described above was also shown.

Figure 8A:
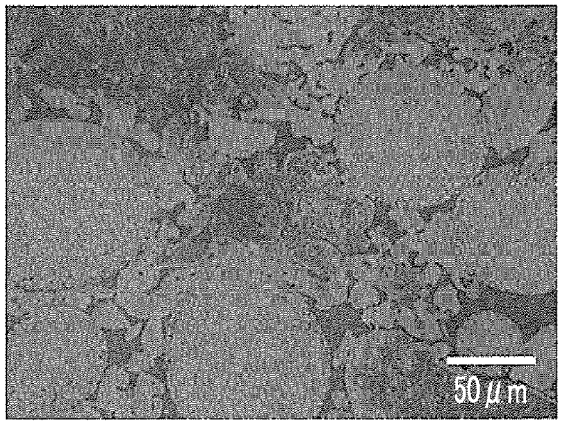
FIG. 8A is a structure photograph of a specimen according to Example 12.
Figure 8B:
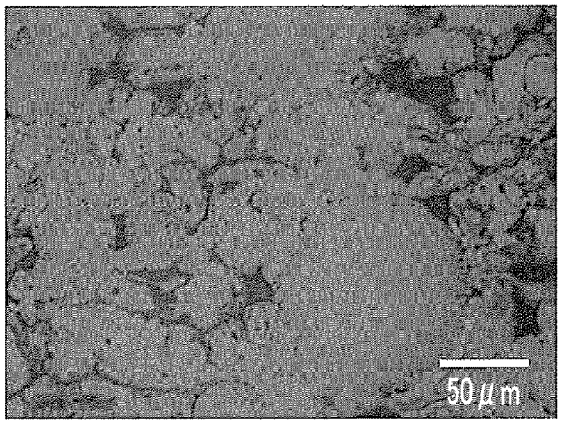
FIG. 8B is a structure photograph of a specimen according to Comparative Example 6.
Figure 8C:
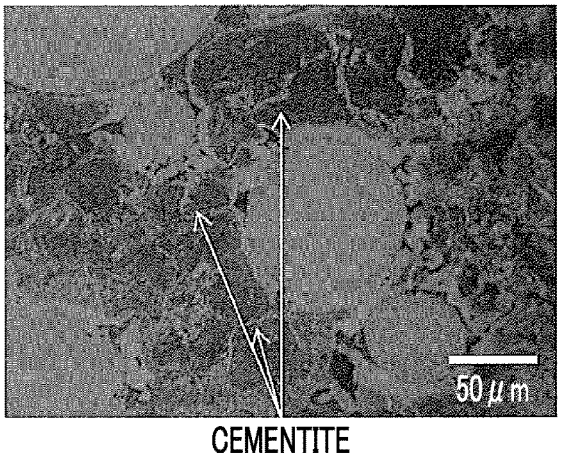
FIG. 8C is a structure photograph of a specimen according to Comparative Example 7.

Etching was performed on the specimens of Example 12 and Comparative Examples 6 and 7 using natal, and the structures of the sintered alloys thereof were observed with a microscope. The results are shown in FIGS. 8A to 8C. FIG. 8A is a structure photograph of the specimen according to Example 12, FIG. 8B is a structure photograph of the specimen according to Comparative Example 6, and FIG. 8C is a structure photograph of the specimen according to Comparative Example 7.

Results 3: Optimal Addition Amount of Graphite Particles

As shown in FIG. 7A, the axial wear amounts of Examples 11 to 13 and Comparative Example 7 were smaller than that of Comparative Example 6. However, as shown in FIG. 7B, the cutting tool wear amount of Comparative Example 7 was greater than those of Examples 11 to 13.

As shown in FIG. 8A, in the structure of the sintered alloy shown in Example 12, a pearlitic structure was formed. However, as shown in FIG. 8C, in the structure of the sintered alloy shown in Comparative Example 7, due to an increase in the amount of the graphite particles, a cementite structure was formed. Accordingly, it is thought that the cutting tool wear amount of Comparative Example 7 was greater than those of Examples 11 to 13. On the other hand, as illustrated in FIG. 8B, the structure of the sintered alloy shown in Comparative Example 6 became a structure primarily with ferrite. Therefore, it is thought that the axial wear amount of Comparative Example 6 became greater than those of Examples 11 to 13 and Comparative Example 7. From this, the optimal addition amount of the graphite particles with which the iron-based base can ensure a pearlitic structure after sintering is 0.5 to 1.5 mass % with respect to the mixed powder.

Examples 14 and 15: Optimal Particle Size of Second Hard Particles

Specimens of sintered alloys were produced in the same manner as in Example 2. Examples 14 and 15 are examples for evaluating the optimal particle size of the second hard particles. Examples 14 and 15 are different from Example 2 in that as the second hard particles, the second hard particles which were sequentially classified to have a particle size in a range of 45 μm or smaller and to have a particle size in a range of greater than 45 μm and equal to or smaller than 75 μm were used as shown in Table 4.

TABLE 3

| | First hard particles | | Second hard particles | | | Graphite particles |
|---|---|---|---|---|---|---|
| | Components | Addition amount (mass %) | Components | Particle size (μm) | Addition amount (mass %) | Addition amount (mass %) |
| Comparative Example 6 | Fe—40Mo—30Ni—20Co—5Mn—0.8Si—1.2C | 40 | FeMo | ~75 | 3 | 0.4 |
| Example 11 | Fe—40Mo—30Ni—20Co—5Mn—0.8Si—1.2C | 40 | FeMo | ~75 | 3 | 0.5 |
| Example 12 | Fe—40Mo—30Ni—20Co—5Mn—0.8Si—1.2C | 40 | FeMo | ~75 | 3 | 1.1 |
| Example 13 | Fe—40Mo—30Ni—20Co—5Mn—0.8Si—1.2C | 40 | FeMo | ~75 | 3 | 1.5 |
| Comparative Example 7 | Fe—40Mo—30Ni—20Co—5Mn—0.8Si—1.2C | 40 | FeMo | ~75 | 3 | 1.6 |

| | Sintered body Components (mass %) | Wear resistance Wear amount (μm) | Machinability Cutting tool wear amount (μm) |
|---|---|---|---|
| Comparative Example 6 | Fe—18.0Mo—12.0Ni—8.0Co—2.0Mn—0.35Si—0.8C | 48 | 70 |
| Example 11 | Fe—18.0Mo—12.0Ni—8.0Co—2.0Mn—0.35Si—0.9C | 40 | 71 |
| Example 12 | Fe—18.0Mo—12.0Ni—8.0Co—2.0Mn—0.35Si—1.5C | 27 | 74 |
| Example 13 | Fe—18.0Mo—12.0Ni—8.0Co—2.0Mn—0.35Si—1.8C | 28 | 90 |
| Comparative Example 7 | Fe—18.0Mo—12.0Ni—8.0Co—2.0Mn—0.35Si—1.9C | 29 | 101 |

Comparative Examples 8 and 9: Comparative Examples of Optimal Particle Size of Second Hard Particles Specimens of sintered alloys were produced in the same manner as that in Example 14. Comparative Examples 8 and 9 are comparative examples for evaluating the optimal particle size of the second hard particles. Comparative Examples 8 and 9 are different from Example 14 in that as the second hard particles, the second hard particles which were sequentially classified to have a particle size in a range of greater than 75 μm and equal to or smaller than 100 μm and to have a particle size in a range of greater than 100 μm and equal to or smaller than 150 μm were used as shown in Table 4. In addition, the specimens according to Comparative Examples 8 and 9 are sintered alloys included in the range of the present disclosure and were represented by Comparative Examples 8 and 9 for comparison to Examples 14 and 15 for convenience.

Figure 9A:
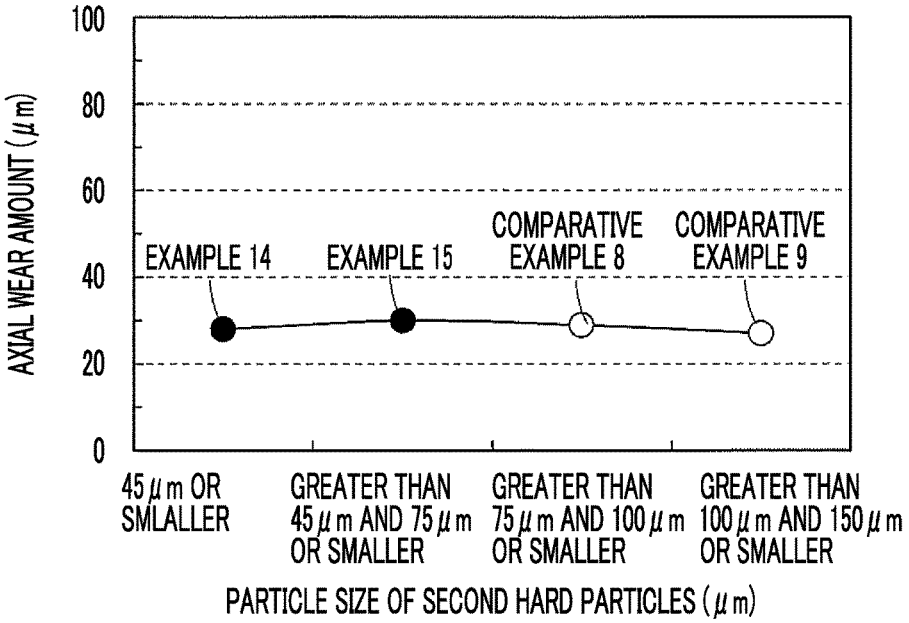
FIG. 9A is a graph showing results of axial wear amounts of Examples 14 and 15 and Comparative Examples 8 and 9 after the wear test.

In the same manner as in Example 1, a wear test was conducted on the specimens of Examples 14 and 15 and Comparative Examples 8 and 9, and the axial wear amounts thereof after the wear test were measured. The results are shown in Table 4 and FIG. 9A. FIG. 9A is a graph showing the results of the axial wear amounts of Examples 14 and 15 and Comparative Examples 8 and 9 after the wear test.

Figure 9B:
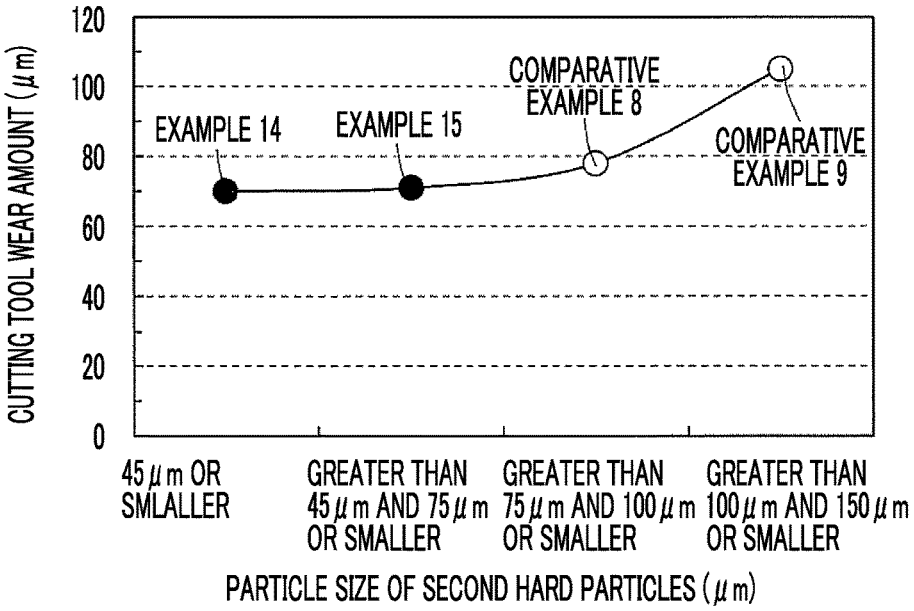
FIG. 9B is a graph showing results of cutting tool wear amounts of Examples 14 and 15 and Comparative Examples 8 and 9 after the machinability test.

In the same manner as in Example 1, a machinability test was conducted on the specimens of Examples 14 and 15 and Comparative Examples 8 and 9, and the cutting tool wear amounts thereof after the machinability test were measured. The results are shown in Table 4 and FIG. 9B. FIG. 9B is a graph showing the results of the cutting tool wear amounts of Examples 14 and 15 and Comparative Examples 8 and 9 after the machinability test.

amount. However, as shown in FIG. 9B, the cutting tool wear amounts of Examples 14 and 15 were smaller than those of Comparative Examples 8 and 9. This is because in Comparative Examples 8 and 9, the particle size of the second hard particles was too great such that the machinability of the specimen increased. From the results, it is preferable that the particle size (maximum particle size) of the second hard particles is in a range of 75 μm or smaller.

While the embodiments of the present disclosure have been described above in detail, the present disclosure is not limited to the embodiments described above, and various changes in design can be made without departing from the spirit of the present disclosure described in the appended claims.

What is claimed is:

1. A production method of a sintered alloy comprising:

compacting mixed powder containing first hard particles, second hard particles, graphite particles, and iron particles into a sintered-alloy compact; and sintering the sintered-alloy compact while diffusing carbons in the graphite particles of the sintered-alloy compact into the first hard particles, the second hard particles, and the iron particles, wherein the first hard particles contain 20 to 70 mass % of Mo, 5 to 40 mass % of Ni, 5 to 40 mass % of Co, 1 to 20 mass % of Mn, 0.5 to 4.0 mass % of Si, 0.5 to 3.0 mass % of C, and a remainder including Fe and unavoidable impurities, when the first hard particles have 100 mass %, the second hard particles contain 60 to 70 mass % of Mo, and 2.0 mass % or less of Si, and a remainder including Fe and unavoidable impurities, when the second hard particles have 100 mass %, and the mixed powder contains 5 to 50 mass % of the first hard particles, 1 to 8 mass % of the second hard particles, and 0.5 to 1.5 mass % of the graphite particles, when

TABLE 4

| | First hard particles | | Second hard particles | | | Graphite particles |
|---|---|---|---|---|---|---|
| | Components | Addition amount (mass %) | Components | Particle size (μm) | Addition amount (mass %) | Addition amount (mass %) |
| Example 14 | Fe—40Mo—30Ni—20Co—5Mn—0.8Si—1.2C | 40 | FeMo | 45 or smaller | 3 | 1.1 |
| Example 15 | Fe—40Mo—30Ni—20Co—5Mn—0.8Si—1.2C | 40 | FeMo | Greater than 45 and 75 or smaller | 3 | 1.1 |
| Comparative Example 8 | Fe—40Mo—30Ni—20Co—5Mn—0.8Si—1.2C | 40 | FeMo | Greater than 75 and 100 or smaller | 3 | 1.1 |
| Comparative Example 9 | Fe—40Mo—30Ni—20Co—5Mn—0.8Si—1.2C | 40 | FeMo | Greater than 100 and 150 or smaller | 3 | 1.1 |

| | Sintered body Components (mass %) | Wear resistance Wear amount (μm) | Machinability Cutting tool wear amount (μm) |
|---|---|---|---|
| Example 14 | Fe—18.0Mo—12.0Ni—8.0Co—2.0Mn—0.35Si—1.5C | 28 | 70 |
| Example 15 | Fe—18.0Mo—12.0Ni—8.0Co—2.0Mn—0.35Si—1.5C | 30 | 71 |
| Comparative Example 8 | Fe—18.0Mo—12.0Ni—8.0Co—2.0Mn—0.35Si—1.5C | 29 | 78 |
| Comparative Example 9 | Fe—18.0Mo—12.0Ni—8.0Co—2.0Mn—0.35Si—1.5C | 27 | 105 |

Results 4: Optimal Particle Size of Second Hard Particles

As shown in Table 9A, Examples 14 and 15 and Comparative Examples 8 and 9 had the same degree of axial wear total mass of the first hard particles, the second hard particles, the graphite particles, and the iron particles is set as 100 mass %.

2. The production method according to claim 1, wherein when the first hard particles have 100 mass %, the first particles further contain 10 mass % or less of Cr.

3. The production method according to claim 1, wherein a particle size of the second hard particles is 75 μm or smaller.

4. The production method according to claim 1, wherein the sintered-alloy compact is sintered by being heated to 1050° C. to 1250° C.

5. The production method according to claim 1, wherein when the first hard particles have 100 mass %, the first hard particles contain 30 to 50 mass % of Mo, 20 to 40 mass % of Ni, 10 to 30 mass % of Co, 2 to 8 mass % of Mn, 0.5 to 2.0 mass % of Si, and 0.5 to 2.0 mass % of C.

6. A compact for sintering comprising:

first hard particles containing 20 to 70 mass % of Mo, 5 to 40 mass % of Ni, 5 to 40 mass % of Co, 1 to 20 mass % of Mn, 0.5 to 4.0 mass % of Si, 0.5 to 3.0 mass % of C, and a remainder including Fe and unavoidable impurities, when the first hard particles have 100 mass %;

second hard particles containing 60 to 70 mass % of Mo, 2.0 mass % or less of Si, and a remainder including Fe and unavoidable impurities, when the second hard particles have 100 mass %;

graphite particles; and iron particles, wherein when total mass of the first hard particles, the second hard particles, the graphite particles, and the iron particles is set as 100 mass %, 5 to 50 mass % of the first hard particles, 1 to 8 mass % of the second hard particles, and 0.5 to 1.5 mass % of the graphite particles are included.

7. The compact for sintering according to claim 6, wherein when the first hard particles have 100 mass %, the first hard particles further contains 10 mass % or less of Cr.

8. The compact for sintering according to claim 6, wherein a particle size of the second hard particles is 75 μm or smaller.

9. The compact for sintering according to claim 6, wherein when the first hard particles have 100 mass %, the first hard particles contain 30 to 50 mass % of Mo, 20 to 40 mass % of Ni, 10 to 30 mass % of Co, 2 to 8 mass % of Mn, 0.5 to 2.0 mass % of Si, and 0.5 to 2.0 mass % of C.

10. A sintered alloy obtained by sintering a compact comprising first hard particles containing 20 to 70 mass % of Mo, 5 to 40 mass % of Ni, 5 to 40 mass % of Co, 1 to 20 mass % of Mn, 0.5 to 4.0 mass % of Si, 0.5 to 3.0 mass % of C, and a remainder including Fe and unavoidable impurities, when the first hard particles have 100 mass %;

second hard particles containing 60 to 70 mass % of Mo, 2.0 mass % or less of Si, and a remainder including Fe and unavoidable impurities, when the second hard particles have 100 mass %;

graphite particles; and iron particles, wherein when total mass of the first hard particles, the second hard particles, the graphite particles, and the iron particles is set as 100 mass %, 5 to 50 mass % of the first hard particles, 1 to 8 mass % of the second hard particles, and 0.5 to 1.5 mass % of the graphite particles are included.

* * * * *